US011173332B2

(12) United States Patent
Takefuji et al.

(10) Patent No.: US 11,173,332 B2
(45) Date of Patent: Nov. 16, 2021

(54) FIRE EXTINGUISHING SYSTEM

(71) Applicants: MORITA MIYATA CORPORATION, Tokyo (JP); Yoshiyasu Takefuji, Kanagawa (JP)

(72) Inventors: Yoshiyasu Takefuji, Kanagawa (JP); Karuro Itsuka, Kanagawa (JP); Tomoya Kita, Kanagawa (JP); Susumu Kurioka, Kanagawa (JP); Hiroaki Tanigawa, Kanagawa (JP); Taichi Yamamura, Kanagawa (JP)

(73) Assignees: MORITA MIYATA CORPORATION, Tokyo (JP); Yoshiyasu Takefuji, Kanagawa (JP)

( * ) Notice: Subject to any disclaimer, the term of this patent is extended or adjusted under 35 U.S.C. 154(b) by 31 days.

(21) Appl. No.: 16/485,411

(22) PCT Filed: Dec. 5, 2017

(86) PCT No.: PCT/JP2017/043668
§ 371 (c)(1),
(2) Date: Aug. 12, 2019

(87) PCT Pub. No.: WO2018/150688
PCT Pub. Date: Aug. 23, 2018

(65) Prior Publication Data

US 2019/0381347 A1 Dec. 19, 2019

(30) Foreign Application Priority Data

Feb. 17, 2017 (JP) ..... JP2017-027437

(51) Int. Cl.
*A62C 37/40* (2006.01)
*A62C 35/13* (2006.01)

(52) U.S. Cl.
CPC ..... *A62C 35/13* (2013.01); *A62C 37/40* (2013.01)

(58) Field of Classification Search
CPC ..... A62C 35/13; A62C 37/40
(Continued)

(56) References Cited

U.S. PATENT DOCUMENTS 5,691,704 A * 11/1997 Wong ..... G08B 17/10 340/628
5,831,537 A * 11/1998 Marman ..... G08B 17/117 340/628
6,166,647 A * 12/2000 Wong ..... G08B 17/10 340/522

FOREIGN PATENT DOCUMENTS

CN 1374231 A 10/2002
CN 105214246 A 1/2016
(Continued)

OTHER PUBLICATIONS

International Search Report for International Application No. PCT/JP2017/043668 dated Feb. 20, 2018 (2 sheets).
(Continued)

*Primary Examiner* — Chee-Chong Lee
(74) *Attorney, Agent, or Firm* — Kratz, Quintos & Hanson, LLP

(57) ABSTRACT

The present invention provides a fire extinguishing system capable of reliably carrying out initial fire fighting using a limited fire extinguisher even if a protected area is wide for example. A control unit 20 of the fire extinguishing system of the invention includes an ignition point judging unit 21 for judging an ignition point from heat source information, a fire determining unit 22 for determining whether a fire breaks out from the heat source information, an ejecting unit selecting unit 23 for selecting one or some of fire extinguisher ejecting units 2 which eject the fire extinguisher by
(Continued)

the ignition point judged by the ignition point judging unit 21 when the fire determining unit 22 determines that the fire breaks out, an operation direction calculating unit 24 for calculating an operation direction of an ejecting unit driving unit 3 corresponding to the fire extinguisher ejecting unit 2 selected by the ejecting unit selecting unit 23, and an output unit 25 for outputting, to the ejecting unit driving unit 3, driving instructions of the operation direction calculated by the operation direction calculating unit 24 and outputting ejection instructions to the fire extinguisher ejecting unit 2 selected by the ejecting unit selecting unit 23.

2 Claims, 2 Drawing Sheets

(58) Field of Classification Search
USPC ..... 169/61
See application file for complete search history.

(56) References Cited

FOREIGN PATENT DOCUMENTS

| | | | |
|---|---|---|---|
| CN | 205095295 | U | 3/2016 |
| JP | H9-245275 | A | 9/1997 |
| JP | H9-290031 | A | 11/1997 |
| JP | 2001-143169 | A | 5/2001 |
| JP | 2002-172184 | A | 6/2002 |
| JP | 2004-192245 | A | 7/2004 |
| JP | 2007-66218 | A | 3/2007 |
| JP | 2012-81144 | A | 4/2012 |
| JP | 2016-179034 | A | 10/2016 |

OTHER PUBLICATIONS

Office Action of Chinese Patent Application No. 201780086564.3 dated Jun. 19, 2020 (24 sheets, 13 sheets translation, 37 sheets total).
Wu Yongbei; "Fire detection and control process"; China University of Science and Technology Press; 2nd Edition; pp. 452-454 (3 sheets, 2 cover sheets, 5 sheets total).
"Real Estate Facility Management"; Yi Election; Wuhan University of Technology Press; pp. 333 (3 sheets, 1 cover sheet, 4 sheets total).
Chinese Search Report from State Intellectual Property Office of the People's Republic of China in corresponding Chinese Patent Application No. 2017800865643 dated Jan. 22, 2021 (3 sheets, 2 sheets translation, 5 sheets total).
He Zhende, et al.; "Introduction to Urban Disaster"; Tianjin Univeresity Press; 2005; pp. 193-197 (5 sheets, 2 cover sheets, 7 sheets total).
Office Action of Chinese Patent Application No. 2017800865643 dated Apr. 29, 2021 (2 sheets, 1 sheet translation, 3 sheets total).
Li Tianwei, et al.; "Construction Fire Equipment Engineering Process"; Chungking University Press; 2007 (7 sheets).
He Zhende, et al.; "Introduction to Urban Disaster"; Tianjin University Press; 2005; pp. 193-197 (5 sheets, 2 cover sheets, 7 sheets total).

* cited by examiner

【fig.1】
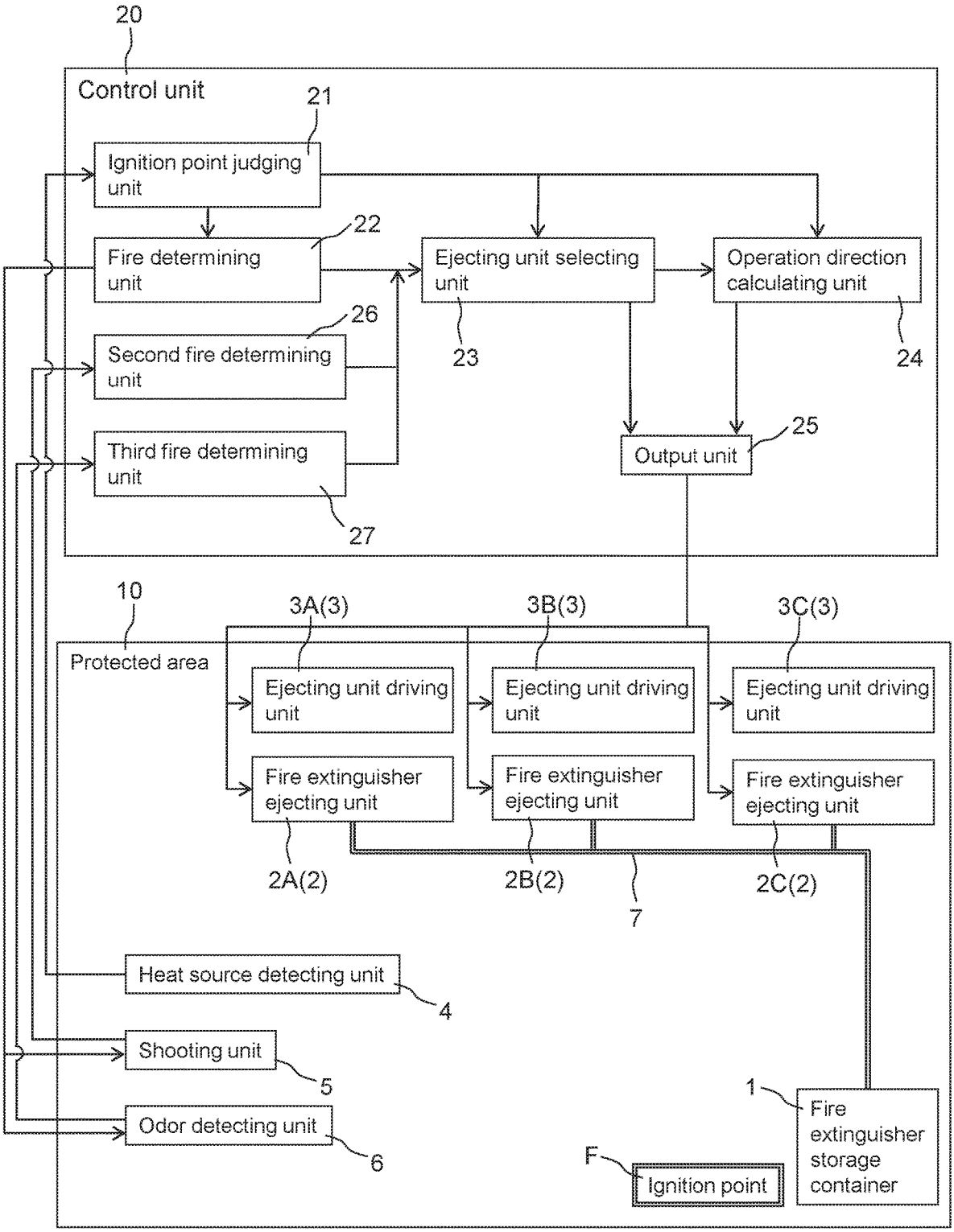

【fig.2】
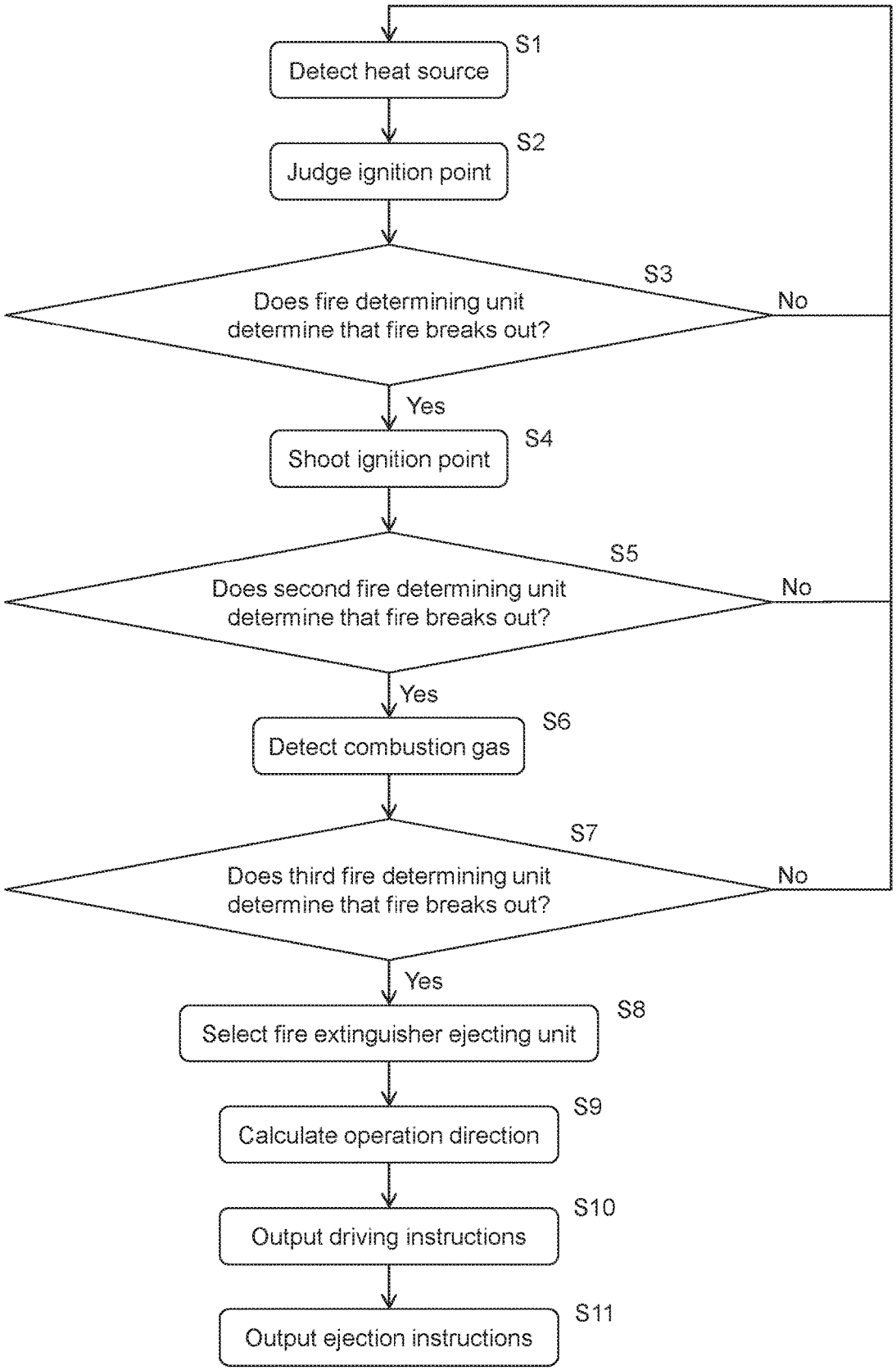

FIRE EXTINGUISHING SYSTEM

TECHNICAL FIELD

The present invention relates to fire extinguishing system using a fire extinguisher filled in a fire extinguisher storage container.

BACKGROUND TECHNIQUE

As a fire extinguishing system for a predetermined protected area, a sprinkler is generally used (e.g., patent document 1).

In the meantime, patent document 2 proposes a fire extinguishing device which identifies a fire source by an infrared camera and controls a water-discharging angle of a water-discharging nozzle based on information of the fire source.

Patent document 3 proposes a fire extinguishing device which accurately controls a nozzle relative to a flame using an ultraviolet rays sensing unit and an infrared rays sensing unit.

PRIOR ART DOCUMENTS

Patent Documents

[Patent Document 1] Japanese Patent Application Laid-open No. 2016-179034

[Patent Document 2] Japanese Patent Application Laid-open No. H9-245275

[Patent Document 3] Japanese Patent Application Laid-open No. H9-290031

SUMMARY OF THE INVENTION

Problem to be Solved by the Invention

However, according to the fire extinguishing system using the fire extinguisher filled in the fire extinguisher storage container, the fire extinguisher is limited. Therefore, if the fire extinguisher is ejected from all of a plurality of ejection ports like the sprinkler in the patent document 1, ejection time of the fire extinguisher becomes extremely short and there is a possibility that fire fighting cannot sufficiently be carried out.

By detecting the fire source or a flame and appropriately controlling the nozzle like the patent documents 2 and 3, a limited fire extinguisher can effectively be utilized.

However, although fire fighting can sufficiently be carried out in a limited space, if the protected area is wide, a distance to an ignition point becomes long, and it is difficult to sufficiently carry out the fire fighting.

Hence, it is an object of the present invention to provide a fire extinguishing system capable of reliably carrying out the initial fire fighting using a limited fire extinguisher even if a protected area is wide.

Means for Solving the Problem

A fire extinguishing system of the present invention includes: a fire extinguisher storage container in which a fire extinguisher is filled; a plurality of fire extinguisher ejecting units for ejecting the fire extinguisher; a fire extinguisher pipe for connecting the fire extinguisher storage container and the respective fire extinguisher ejecting units to each other; an ejecting unit driving unit for changing ejecting directions of the respective fire extinguisher ejecting units; a heat source detecting unit for detecting heat source information including at least one of a position, a temperature, a shape, a size, a color, a brightness and a fluctuation of the heat source; and a control unit inputting the heat source information detected by the heat source detecting unit, and controlling a driving condition at the ejecting unit driving unit and an ejecting condition of the fire extinguisher from the fire extinguisher ejecting unit; wherein the control unit includes an ignition point judging unit for judging an ignition point from the heat source information, a fire determining unit for determining whether a fire breaks out from the heat source information, an ejecting unit selecting unit for selecting one or some of the fire extinguisher ejecting units which eject the fire extinguisher by the ignition point judged by the ignition point judging unit when the fire determining unit determines that the fire breaks out, an operation direction calculating unit for calculating an operation direction of the ejecting unit driving unit corresponding to the fire extinguisher ejecting unit selected by the ejecting unit selecting unit, and an output unit for outputting, to the ejecting unit driving unit, driving instructions of the operation direction calculated by the operation direction calculating unit and outputting ejection instructions to the fire extinguisher ejecting unit selected by the ejecting unit selecting unit.

In the fire extinguishing system described above, a thermo camera is used as the heat source detecting unit, a temperature distribution is detected as the heat source information, the ignition point judging unit judges a position of a maximum temperature as the ignition point, and the fire determining unit determines that the fore breaks out when a temperature at the ignition point is equal to or higher than a threshold.

The fire extinguishing system described above further includes a shooting unit for shooting the ignition point judged by the ignition point judging unit, and a second fire determining unit for determining whether the fire breaks out from a flame element including at least one of least one of a shape, a size, a color, a brightness and a fluctuation of flame at the ignition point shot by the shooting unit, wherein in the control unit, determination of the second fire determining unit is made when the fire determining unit determines that the fire breaks out.

The fire extinguishing system described above further includes an odor detecting unit for obtaining ambient gas and detecting combustion gas, and a third fire determining unit for determining whether the fire breaks out from the combustion gas detected by the odor detecting unit, wherein in the control unit, determination of the third fire determining unit is made when the fire determining unit determines that the fire breaks out.

The ejecting unit selecting unit selects one or some of the fire extinguisher ejecting units which eject the fire extinguisher depending upon distances from the ignition point to the respective fire extinguisher ejecting units.

In the fire extinguishing system described above, the ejecting unit selecting unit selects at least two fire extinguisher ejecting units.

Effect of the Invention

According to the fire extinguishing system of the invention, it is possible to reliably carry out the initial fire fighting using a limited fire extinguisher.

BRIEF DESCRIPTION OF THE DRAWINGS

FIG. 1 is a block diagram of a fire extinguishing system of an embodiment of the present invention described based on function-realizing means; and FIG. 2 is a flowchart showing operations in the fire extinguishing system.

MODE FOR CARRYING OUT THE INVENTION

In a fire extinguishing system according to a first embodiment of the present invention, a control unit includes an ignition point judging unit for judging an ignition point from heat source information, a fire determining unit for determining whether a fire breaks out from the heat source information, an ejecting unit selecting unit for selecting one or some of fire extinguisher ejecting units which eject fire extinguishers by the ignition point judged by the ignition point judging unit when the fire determining unit determines that the fire breaks out, an operation direction calculating unit for calculating an operation direction of an ejecting unit driving unit corresponding to the fire extinguisher ejecting unit selected by the ejecting unit selecting unit, and an output unit for outputting, to the ejecting unit driving unit, driving instructions of the operation direction calculated by the operation direction calculating unit and outputting ejection instructions to the fire extinguisher ejecting unit selected by the ejecting unit selecting unit. According to this embodiment, it is possible to reliably carry out the initial fire fighting using the limited fire extinguisher filed in the fire extinguisher storage container.

According to a second embodiment of the invention, in the fire extinguishing system of the first embodiment, a thermo camera is used as the heat source detecting unit, a temperature distribution is detected as the heat source information, the ignition point judging unit judges a position of a maximum temperature as the ignition point, and the fire determining unit determines that the fore breaks out when a temperature at the ignition point is equal to or higher than a threshold. According to this embodiment, it is possible to detect ignition point and determine fire by using the thermo camera as the heat source detecting unit.

According to a third embodiment of the invention, the fire extinguishing system of the first or second embodiment further includes a shooting unit for shooting the ignition point judged by the ignition point judging unit, and a second fire determining unit for determining whether the fire breaks out from a flame element including at least one of least one of a shape, a size, a color, a brightness and a fluctuation of flame at the ignition point shot by the shooting unit, wherein in the control unit, determination of the second fire determining unit is made when the fire determining unit determines that the fire breaks out. According to this embodiment, since the fire extinguishing system further includes the second fire determining unit, it is possible to accurately carry out the fire determination, and reduce erroneous determination.

According to a fourth embodiment of the invention, the fire extinguishing system of any one of the first to third embodiments further includes an odor detecting unit for obtaining ambient gas and detecting combustion gas, and a third fire determining unit for determining whether the fire breaks out from the combustion gas detected by the odor detecting unit, wherein in the control unit, determination of the third fire determining unit is made when the fire determining unit determines that the fire breaks out. According to this embodiment, since the fire extinguishing system further includes the third fire determining unit, it is possible to accurately carry out the fire determination, and reduce erroneous determination.

According to a fifth embodiment of the invention, in the fire extinguishing system of any one of the first to fourth embodiments, the ejecting unit selecting unit selects one or some of the fire extinguisher ejecting units which eject the fire extinguisher depending upon distances from the ignition point to the respective fire extinguisher ejecting units. According to this embodiment, it is possible to effectively utilize the limited fire extinguisher, and carry out reliable fire fighting.

According to a sixth embodiment of the invention, in the fire extinguishing system of any one of the first to fifth embodiments, the ejecting unit selecting unit selects at least two fire extinguisher ejecting units. According to this embodiment, since the fire extinguisher can be ejected to ignition point from different directions, it is possible to carry out reliable fire fighting.

EMBODIMENT

A fire extinguishing system according to an embodiment of the present invention will be described below.

FIG. 1 is a block diagram of the fire extinguishing system of this embodiment described based on function-realizing means.

The fire extinguishing system of this embodiment includes a fire extinguisher storage container 1 in which a fire extinguisher is filled, a plurality of fire extinguisher ejecting units 2 through which the fire extinguisher is ejected, an ejecting unit driving unit 3 for changing ejecting directions of the respective fire extinguisher ejecting units 2, a heat source detecting unit 4 for detecting heat source information including at least one of a position, a temperature, a shape, a size, a color, a brightness and a fluctuation of the heat source, a shooting unit 5 for shooting an ignition point F judged by an ignition point judging unit 21, and an odor detecting unit 6 for obtaining ambient or peripheral gas and detecting combustion gas.

The fire extinguisher ejecting units 2, the ejecting unit driving unit 3, the heat source detecting unit 4, the shooting unit 5 and the odor detecting unit 6 are placed in a protected area 10. The protected area 10 is one space defined by a wall or a door such as a living room in a living space or a lobby of a hotel for example.

The fire extinguisher storage container 1 can be placed also outside of the protected area 10. The fire extinguisher storage container 1 and the fire extinguisher ejecting units 2A, 2B and 2C are connected to each other through a fire extinguisher pipe 7.

This embodiment includes the three fire extinguisher ejecting units 2A, 2B and 2C and ejecting unit driving units 3A, 3B and 3C respectively corresponding to the fire extinguisher ejecting units 2A, 2B and 2C.

It is necessary that the number of each of the fire extinguisher ejecting units 2 and the ejecting unit driving units 3 is at least two, and the number is preferably three or more. It is preferable that the plurality of fire extinguisher ejecting units 2 are placed at high locations such as a ceiling surface, and the fire extinguisher ejecting units 2 are separated from one another as far as possible.

The fire extinguishing system of this embodiment includes a control unit 20. Heat source information which is detected by the heat source detecting unit 4, flame information at the ignition point F which is shot by the shooting unit 5, and combustion gas information which is detected by the odor detecting unit 6 are input to the control unit 20. Based on the three information, the control unit 20 controls a driving condition of the ejecting unit driving unit 3 and an ejecting condition of the fire extinguisher from the fire extinguisher ejecting units 2.

The control unit 20 includes the ignition point judging unit 21, a fire determining unit 22, an ejecting unit selecting unit 23, an operation direction calculating unit 24 and an output unit 25.

The ignition point judging unit 21 judges the ignition point F from the heat source information.

The fire determining unit 22 determines whether a fire breaks out from the heat source information.

If the fire determining unit 22 determines that a fire breaks out, the ejecting unit selecting unit 23 selects one of the fire extinguisher ejecting units 2 which ejects a fire extinguisher based on a position of the ignition point F judged by the ignition point judging unit 21.

The operation direction calculating unit 24 calculates an operation direction of the ejecting unit driving unit 3 which corresponds to the fire extinguisher ejecting unit 2 selected by the ejecting unit selecting unit 23.

The output unit 25 outputs, to the ejecting unit driving unit 3, driving instructions of the operation direction calculated by the operation direction calculating unit 24, and outputs ejecting instructions to the fire extinguisher ejecting unit 2 selected by the ejecting unit selecting unit 23.

For example, a case where the fire extinguisher ejecting unit 2 which ejects a fire extinguisher is selected based on a distance from the ignition point F to the respective fire extinguisher ejecting units 2 will be described.

If the fire extinguisher ejecting unit 2A is farthest from the position of the ignition point F and the fire extinguisher ejecting unit 2C is closest to the position of the ignition point F, the ejecting unit selecting unit 23 selects the fire extinguisher ejecting unit 2C as a fire extinguisher ejecting unit 2 which ejects a fire extinguisher. More preferably, the ejecting unit selecting unit 23 selects the fire extinguisher ejecting unit 2C and the fire extinguisher ejecting unit 2B as fire extinguisher ejecting units 2 which eject the fire extinguisher. Since a fire extinguisher can be ejected to the ignition point F from different directions by selecting at least two fire extinguisher ejecting units 2, it is possible to reliably carry out the fire fighting.

The ejecting unit selecting unit 23 can select the fire extinguisher ejecting unit 2 which ejects a fire extinguisher also depending upon a range and strength (temperature) of the ignition point F or a shape of a flame instead of the position of the ignition point F.

If the fire extinguisher ejecting unit 2C is selected, the operation direction calculating unit 24 calculates an operation direction of the ejecting unit driving unit 3C. The output unit 25 outputs driving instructions to the ejecting unit driving unit 3C, and outputs ejecting instructions to the fire extinguisher ejecting unit 2C after the driving operation is completed.

If the fire extinguisher ejecting unit 2C and the fire extinguisher ejecting unit 2B are selected, the operation direction calculating unit 24 calculates the operation directions of the ejecting unit driving unit 3C and the ejecting unit driving unit 3B. The output unit 25 outputs driving instructions to the ejecting unit driving unit 3C and the ejecting unit driving unit 3B, and outputs ejecting instructions to the fire extinguisher ejecting unit 2C and the fire extinguisher ejecting unit 2B after the driving operation is completed.

Although it is described in this embodiment that the ejecting instructions are output to the fire extinguisher ejecting unit 2, if the fire extinguisher storage container 1 and the respective fire extinguisher ejecting units 2 are connected to each other through independent fire extinguisher pipes 7, operations of on-off valves provided in the respective fire extinguisher pipes 7 become the ejecting instructions to the fire extinguisher ejecting units 2.

It is preferable that the control unit 20 further includes a second fire determining unit 26.

The second fire determining unit 26 determines whether a fire breaks out from a flame element including at least one of a shape, a size, a color, a brightness and a fluctuation of a flame at the ignition point F shot by the shooting unit 5. The determination of the second fire determining unit 26 is made when the fire determining unit 22 determines that a fire breaks out. If the control unit 20 further includes the second fire determining unit 26, it is possible to accurately determine the fire, and reduce erroneous determination.

It is preferable that the control unit 20 further includes a third fire determining unit 27.

The third fire determining unit 27 determines whether a fire breaks out from combustion gas detected by the odor detecting unit 6. The determination of the third fire determining unit 27 is made when the fire determining unit 22 determines that a fire breaks out and when the second fire determining unit 26 determines that a fire breaks out. If the control unit 20 further includes the third fire determining unit 27, it is possible to accurately determine the fire, and reduce erroneous determination.

If a thermo camera is used as the heat source detecting unit 4, the heat source detecting unit 4 detects a temperature distribution as heat source information, the ignition point judging unit 21 judges a position of a maximum temperature as the ignition point F, and when the temperature at the ignition point F is equal to or higher than a threshold, the fire determining unit 22 can determine that a fire breaks out. If the thermo camera is used as the heat source detecting unit 4 in this manner, it is possible to detect the ignition point F and determine that a fire breaks out.

FIG. 2 is a flowchart showing operations in the fire extinguishing system in this embodiment.

In step 1, the heat source detecting unit 4 detects, every arbitrary time, heat source information including at least one of a position, a temperature, a shape, a size, a color, a brightness and a fluctuation of a heat source.

The ignition point judging unit 21 judges the ignition point F from the heat source information detected in step 1 (step 2).

The fire determining unit 22 determines whether a fire breaks out from the heat source information detected in step 1 and/or the ignition point F detected in step 2 (step 3).

If the fire determining unit 22 determines that the fire does not break out in step 3, the procedure is returned to step 1 and the heat source information is detected.

If the fire determining unit 22 determines that the fire breaks out in step 3, the shooting unit 5 shoots the ignition point F (step 4).

From the flame element (including at least one of shape, size, color, a brightness and fluctuation of flame) at the ignition point F shot in step 4, the second fire determining unit 26 determines whether a fire breaks out (step 5).

If the second fire determining unit 26 determines that the fire does not break out in step 5, the procedure is returned to step 1 and the heat source information is detected.

If the second fire determining unit 26 determines that a fire breaks out in step 5, the odor detecting unit 6 detects combustion gas (step 6).

The third fire determining unit 27 determines whether a fire breaks out from combustion gas detected in step 6 (step 7).

If the third fire determining unit 27 determines that a fire does not break out in step 7, the procedure is returned to step 1 and the heat source information is detected.

If the third fire determining unit 27 determines that a fire breaks out in step 7, the ejecting unit selecting unit 23 selects one of the fire extinguisher ejecting units 2 which ejects a fire extinguisher (step 8).

The operation direction calculating unit 24 calculates an operation direction of the ejecting unit driving unit 3 corresponding to the fire extinguisher ejecting unit 2 which is selected in step 7 (step 9).

If the operation direction of the ejecting unit driving unit 3 is calculated in step 9, the output unit 25 outputs driving instructions to the ejecting unit driving unit 3 (step 10).

The output unit 25 outputs ejection instructions to the fire extinguisher ejecting unit 2 which is selected by the ejecting unit selecting unit 23 (step 11).

According to this embodiment, it is possible to reliably carry out the initial fire fighting using a limited fire extinguisher filled in the fire extinguisher storage container 1.

INDUSTRIAL APPLICABILITY

The present invention is optimal for a fire extinguishing system which uses a fire extinguisher filled in a fire extinguisher storage container, but the invention can also be applied to a fire extinguishing system which uses fire-fighting water such as a sprinkler.

EXPLANATION OF SYMBOLS

1 fire extinguisher storage container
2 fire extinguisher ejecting unit
3 ejecting unit driving unit
4 heat source detecting unit
5 shooting unit
6 odor detecting unit
7 fire extinguisher pipe
10 protected area
20 control unit
21 ignition point judging unit
22 fire determining unit
23 ejecting unit selecting unit
24 operation direction calculating unit
25 output unit
26 second fire determining unit
27 third fire determining unit

The invention claimed is:

1. A fire extinguishing system comprising:

a fire extinguisher storage container in which a fire extinguisher is filled;

a plurality of nozzles for ejecting the fire extinguisher;

a fire extinguisher pipe for connecting the fire extinguisher storage container and the respective nozzles to each other;

a nozzle driving unit for changing ejecting directions of the respective nozzles;

a heat source detecting unit for detecting heat source information including at least one of a position, a temperature, a shape, a size, a color, a brightness and a fluctuation of the heat source; and a control unit inputting the heat source information detected by the heat source detecting unit, and controlling a driving condition at the nozzle driving unit and an ejecting condition of the fire extinguisher from the nozzle; wherein further comprising a camera for shooting an ignition point, and an odor detecting sensor for obtaining ambient gas and detecting combustion gas;

the respective nozzles are placed separated from one another for ejecting the fire extinguisher to the ignition point from different directions;

the control unit judges the ignition point from the heat source information by an ignition point judging unit;

determines whether a fire breaks out from the heat source information by a fire determining unit;

determines whether the fire breaks out from a flame element including at least one of least one of a shape, a size, a color, a brightness and a fluctuation of flame at the ignition point shot through the camera by a second fire determining unit when the fire determining unit determines that the fire breaks out; and determines whether the fire breaks out from the combustion gas detected by the odor detecting sensor by a third fire determining unit when the second fire determining unit determines that the fire breaks out;

selects at least the two nozzles of the plurality of nozzles including the closest nozzle to the position of the ignition point by a nozzle selecting unit when the third fire determining unit determines that a fire breaks out;

calculates an operation direction of the nozzle driving unit corresponding to the plurality of nozzle which is selected in the nozzle selecting unit by an operation direction calculating unit;

outputs driving instructions to the nozzle driving unit which is calculated by the operation direction calculating unit by an output unit and outputting ejection instructions to the nozzle which is selected through the nozzle selecting unit by the output unit.

2. The fire extinguishing system according to claim 1, wherein a thermo camera is used as the heat source detecting unit, a temperature distribution is detected as the heat source information, the control unit judges a position of a maximum temperature as the ignition point by the ignition point judging unit;

determines that the fire breaks out when a temperature at the ignition point is equal to or higher than a threshold by the fire determining unit.

* * * * *